US007175067B2

(12) United States Patent
Roberts

(10) Patent No.: US 7,175,067 B2
(45) Date of Patent: Feb. 13, 2007

(54) SAFETY DEVICE FOR BANK NOTE STORAGE APPARATUS

(75) Inventor: Philip Roberts, Leicester (GB)

(73) Assignee: Volumatic Limited (GB)

( * ) Notice: Subject to any disclaimer, the term of this patent is extended or adjusted under 35 U.S.C. 154(b) by 84 days.

(21) Appl. No.: 11/005,364

(22) Filed: Dec. 6, 2004

(65) Prior Publication Data

US 2005/0121502 A1 Jun. 9, 2005

(30) Foreign Application Priority Data

Dec. 6, 2003 (GB) ..... 0328393.4

(51) Int. Cl.
*G07B 15/00* (2006.01)

(52) U.S. Cl. ..... 232/15; 232/16; 194/200; 109/45

(58) Field of Classification Search ..... 232/1 D, 232/15, 16, 31, 32; 109/45–47; 902/9, 13; 194/200, 202; 235/379
See application file for complete search history.

(56) References Cited

U.S. PATENT DOCUMENTS

| | | | | |
|---|---|---|---|---|
| 3,655,186 A | | 4/1972 | Bayha | |
| 3,854,655 A | * | 12/1974 | Armstrong | 232/4 R |
| 4,552,075 A | * | 11/1985 | Glasson et al. | 109/52 |
| 4,790,476 A | | 12/1988 | Tanaka et al. | |
| 4,913,341 A | * | 4/1990 | Bachman | 232/1 D |
| 5,176,315 A | | 1/1993 | Homel | |
| 5,595,129 A | | 1/1997 | Grobe | |
| 5,607,102 A | | 3/1997 | Walsh et al. | |
| 5,850,966 A | * | 12/1998 | Siler et al. | 232/15 |
| 5,890,439 A | | 4/1999 | McGunn | |
| 6,024,531 A | | 2/2000 | Schulze | |
| 6,244,504 B1 | * | 6/2001 | Holland-Letz | 232/15 |
| 2003/0180313 A1 | * | 9/2003 | Cloyd et al. | 424/188.1 |
| 2006/0071412 A1 | * | 4/2006 | Lewis | 271/213 |

FOREIGN PATENT DOCUMENTS

| | | |
|---|---|---|
| EP | 0124729 | 11/1984 |
| EP | 0674296 | 9/1995 |
| GB | 2199890 | 7/1988 |
| GB | 2213870 | 8/1989 |
| GB | 2236143 | 3/1991 |
| GB | 2313622 | 12/1997 |
| WO | WO 02/19289 | 3/2002 |

* cited by examiner

*Primary Examiner*—William L. Miller
(74) *Attorney, Agent, or Firm*—Akerman Senterfitt; Joseph W. Bain; Peter A. Chiabotti

(57) ABSTRACT

The application is directed to a safety device for a bank note storage apparatus. If banknotes are not place properly in the compartment of the tray but overlie a flange of the safety device as the tray is pushed into the slot and flange will jam between pegs and, causing a body to move back against a spring and a latch to extend downward from the tray. The latch will prevent movement of the tray fully into the enclosure. The user must remove the obstruction before the tray can be moved fully into the enclosure.

6 Claims, 3 Drawing Sheets

SAFETY DEVICE FOR BANK NOTE STORAGE APPARATUS

FIELD OF THE INVENTION

This invention relates to a safety device for a container of the kind comprising a housing, a slot in a wall of the housing and a tray slideable into and out of the housing through the slot to convey items placed in the tray while the tray is extended from the slot into the interior of the housing. An example of such a container is the apparatus for the storage and transport of bank notes described in the International Patent Application published as WO 02/019289. Reference is made to that publication for a clearer understanding of the present invention although the device of the present invention is not limited in its application to apparatus for the storage and transport of bank notes.

BACKGROUND OF THE INVENTION

A problem which has been identified in use of the apparatus of WO 02/019289 is that if bank notes are not fully and properly inserted into the tray before it is closed they may jam in the slot or become bent over the upper surface of the plunger. Any such note may therefore not be pressed by the plunger through the bottom of the tray, in which case it will be accessible when the tray is pulled out again.

A principal object of the present invention is to offer a solution to this problem. If a bank note is not fully inserted into the tray before the tray is pushed into the housing it will actuate a safety device which will prevent the tray from closing. Inability to close the tray will of course alert the user to the problem. After the tray has been pulled out again and the offending note or notes have been properly inserted into the tray the safety device is de-activated and it is possible to push the tray fully into the housing, whereupon the plunger can be operated.

SUMMARY OF THE INVENTION

In accordance with the present invention there is provided a safety device for a container of the kind comprising a housing, a slot in a wall of the housing and a tray slideable into and out of the housing through the slot to convey items placed in the tray while the tray is extended from the slot into the interior of the housing, the safety device comprising a body mounted in the tray to have limited movement relative thereto generally in the direction of movement of the tray, means biasing said body to a forward position in which, as the tray moves into the slot, it substantially fills the cross sectional area between the tray and the slot and a latch depending from the body, the latch having a camming surface which will cooperate with a camming surface of the tray to force the latch downward as the body moves rearwardly and a latch surface adapted to abut said wall below the slot, the arrangement being such that if the slot is obstructed when the tray is moved into the housing the body will be moved rearwardly by the obstruction to a position where the latch will engage said wall to prevent reception of the tray into the housing.

The safety device may be applied to the apparatus described and claimed in the International Patent Application published as WO 02/019289.

The body may have an upstanding flange in the region of its forward end which passes as a close tolerance fit between formations of the housing on opposite sides of the slot as the tray moves into the housing.

Preferably the latch is connected to the body by connection means which biases the latch to a raised position. The connection means may be a strip of resilient material.

Said camming surface of the tray may be a curved internal surface near to the rear of the tray and the camming surface of the latch may be a curved rear surface of the latch.

BRIEF DESCRIPTION OF THE DRAWINGS

A preferred embodiment of the invention will now be described by way of non-limitative example with reference to the accompanying drawings, in which.

DETAILED DESCRIPTION OF A PREFERRED EMBODIMENT

Figure 1:
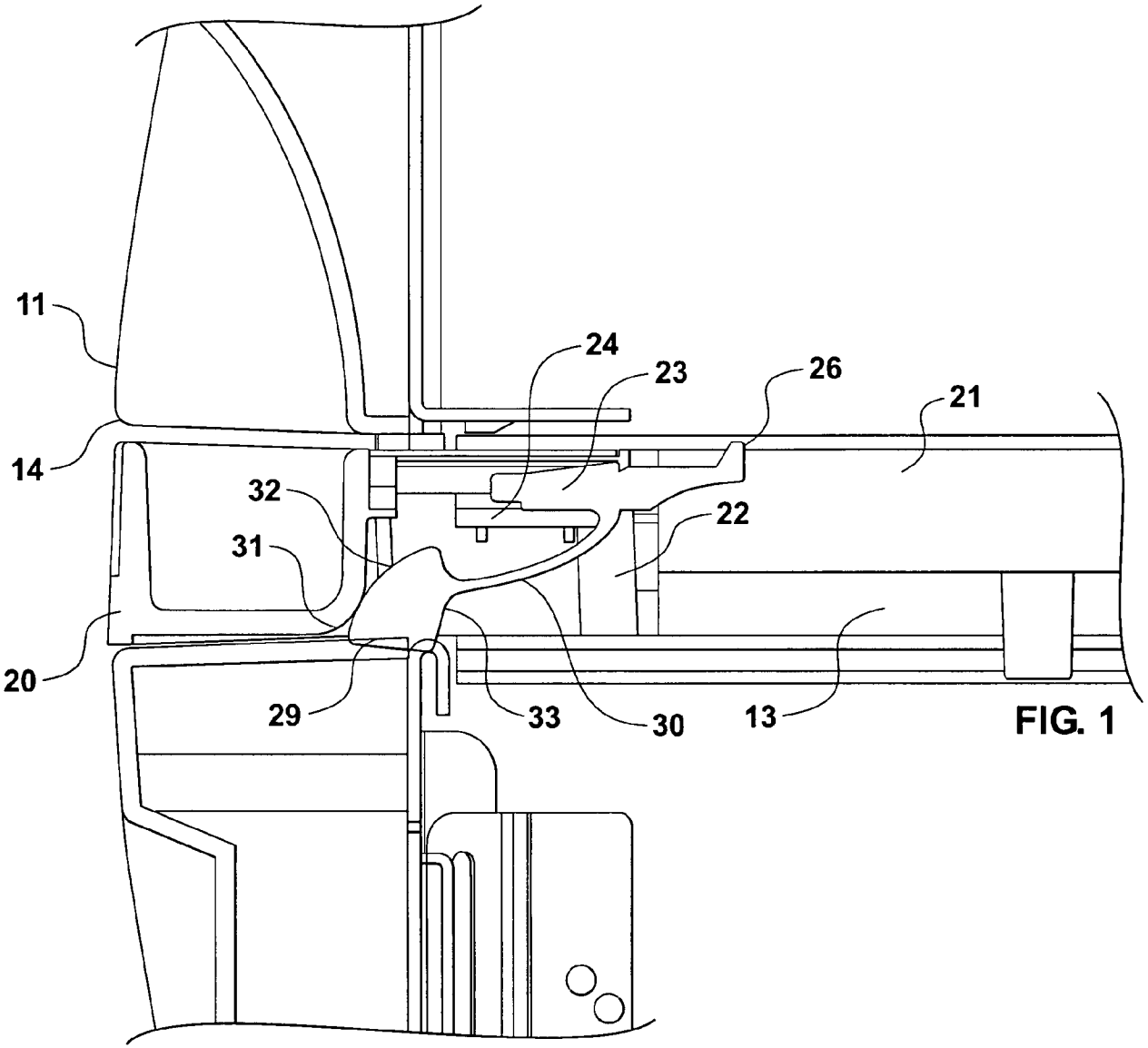
FIG. 1 is a partial sectional elevation through apparatus of the kind described and illustrated in WO 02/019289 but provided with the safety device of the invention.

A box-like enclosure has a front wall 11 in which there is a generally rectangular slot 14. A tray 13 of hollow, open-topped construction is slideable into and out of the enclosure through the slot 14. With the tray fully extended from the enclosure, i.e. fully open, bank notes are placed in it so that when the tray is pushed fully into the enclosure, i.e. fully closed, the bank notes are carried into the interior of the enclosure. By then operating a plunger (not shown) the bank notes can be displaced through the bottom of the tray, so that when the tray is again pulled out it is empty. The safety device discussed herein can be used with a variety of bank note storage apparatuses, such as the apparatus disclosed in WO 02/019289, which is herein incorporated by reference.

The tray 13 has a channel-shaped rear wall 20 and between this and the interior 21 of the tray where bank notes are to be placed is a compartment 22 in which a body 23 is located. This is mounted on a slotted shelf 24 enabling the body 23 to move backward and forward in the compartment 22 in a direction parallel with the direction in which the tray 13 is moveable. The body 23 is biased by a compression spring 25 to the forward position in which it is shown both in FIG. 1 and FIG. 2. The body 23 is generally T-shaped and at its forward end has an upstanding flange 26 which will pass with close tolerance between pegs 27 and 28 depending from the top of the slot 14 as the tray 13 moves into or out of the enclosure.

A latch member 29 is attached to the underside of the body 23 by a resilient strip 30 which, in an unstressed condition (FIG. 1) holds the latch 29 in a raised position. The channel 20 and the rear of the latch member 29 have cooperating cam surfaces 31 and 32. The front surface 33 of the latch is straight.

Figure 2:
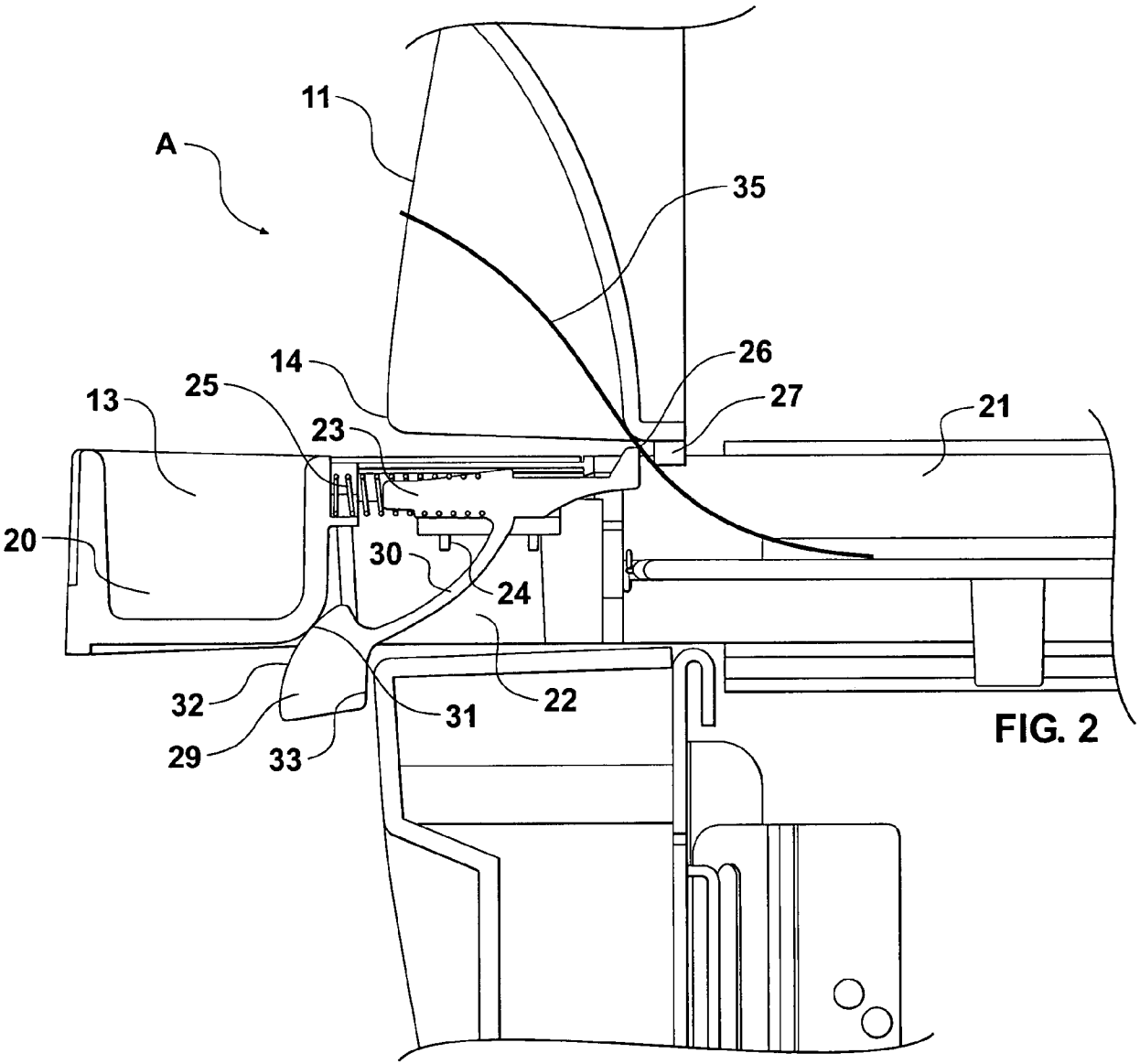
FIG. 2 is a view similar to FIG. 1 but showing the tray in a partially open position.
Figure 3:
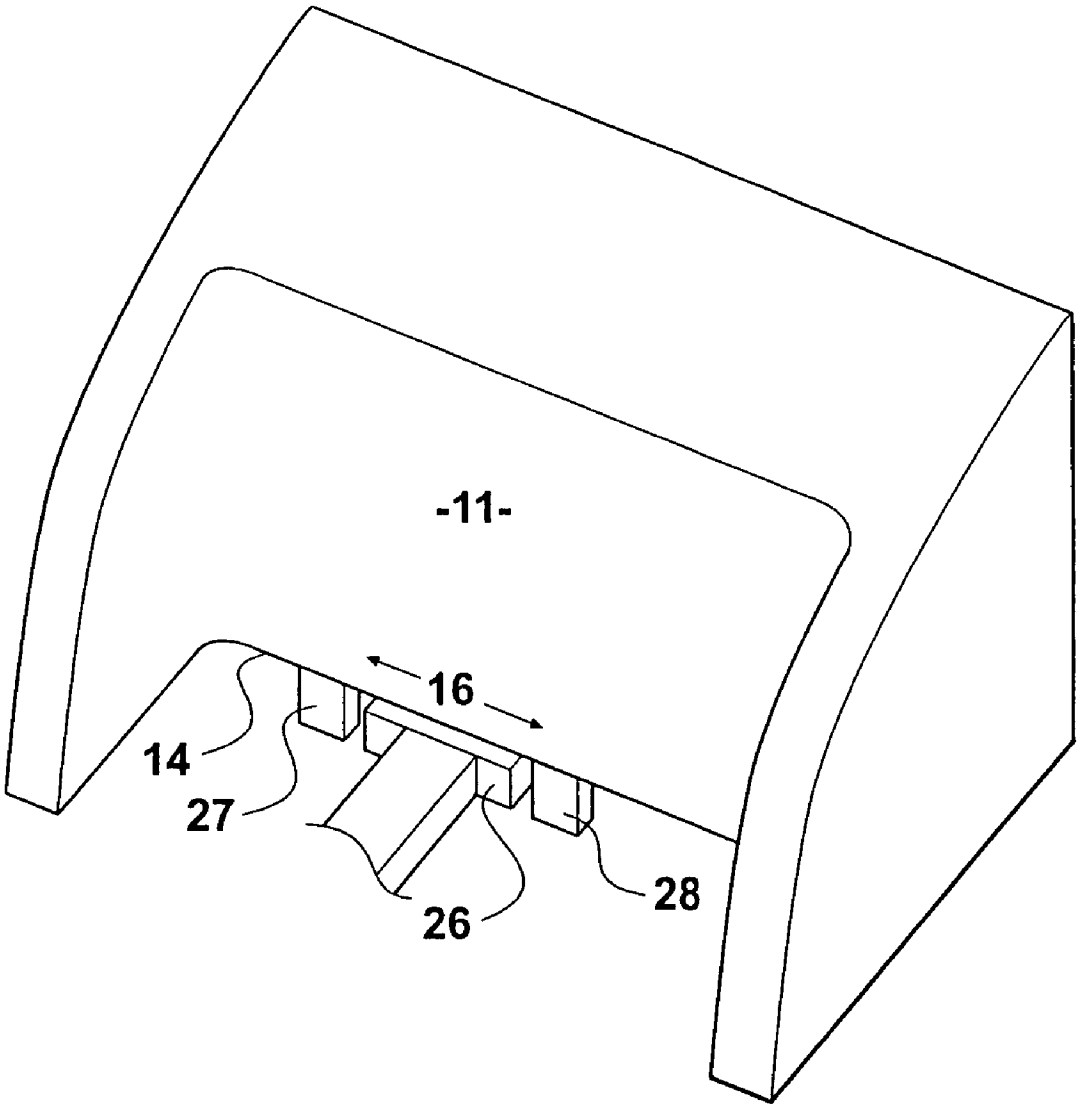
FIG. 3 is a schematic, partial view taken in the direction of the arrow A in FIG. 2.

If the flange 26 can pass freely between the pegs 27 and 28 the spring 25 will hold the body 23 in its forward position in the compartment 22. The latch 29 is held in a raised position by the strip 30 and the tray 13 is free to slide through the slot 14 into and out of the enclosure (FIG. 1). If, however, with the tray pulled out an item such as the banknote 35 of FIG. 2 has not been inserted properly into the compartment 21 of the tray and overlies the flange 26, then when the tray 13 is pushed into the enclosure the note 35 will jam between the pegs 27 and 28 and the flange 26, causing the latter to move back against the action of the spring 25. As this happens the cam surface 32 will be pressed against the cam surface 31, causing the latch 29 to be deflected downwardly against the action of the strip 30 (FIG. 2). As the tray 13 is pushed further into the slot 14 the surface 33 of the latch will abut the wall 11 below the slot 14 arresting the movement of the tray. The user is thus alerted to misplacement of the note 35 and must pull the tray out again to remove it. As the flange 26 moves away from the pegs 27 and 28 the body 23 is moved back to its forward position by the spring 25, raising the latch 29. Provided there is no longer anything overlying the flange 26 the user can push the tray 13 fully into the enclosure (FIG. 1) and the plunger can be operated to displace banknotes out of the tray.

What is claimed is:

1. A safety device for a container comprising a housing, a slot in a wall of the housing and a tray slideable into and out of the housing through the slot to convey items placed in the tray while the tray is extended from the slot into the interior of the housing, the safety device comprising:

a body mounted in the tray to have limited movement relative thereto generally in the direction of movement of the tray, means biasing said body to a forward position in which, as the tray moves into the slot, it substantially fills the cross sectional area between the tray and the slot, and a latch depending from the body, the latch having a camming surface which will cooperate with a camming surface of the tray to force the latch downward as the body moves rearwardly and a latch surface adapted to abut said wall below the slot, the arrangement being such that if the slot is obstructed by one of said items when the tray is moved into the housing the body will be moved rearwardly to a position where the latch will engage said wall to prevent reception of the tray into the housing.

2. A safety device as claimed in claim 1, wherein the body has an upstanding flange in the region of its forward end which passes as a close tolerance fit between formations of the housing on opposite sides of the slot as the tray moves into the housing.

3. A safety device as claimed in claim 1, wherein the latch is connected to the body by connection means which biases the latch to a raised position.

4. A safety device as claimed in claim 3, wherein the connection means is a strip of resilient material.

5. A safety device as claimed in claim 1, wherein said camming surface of the tray is a curved internal surface near to the rear of the tray.

6. A safety device as claimed in claim 1, wherein the camming surface of the latch is a curved rear surface of the latch.

* * * * *